US005531465A

United States Patent [19]

Aumasson

[11] Patent Number: 5,531,465

[45] Date of Patent: Jul. 2, 1996

[54] SUPPORTING DEVICE WITH ROLLERS, AND SUITCASES COMPRISING AT LEAST ONE SUCH DEVICE

[75] Inventor: Michel Aumasson, Rueil Malmaison, France

[73] Assignee: Delsey (Societe Anonyme), Bobigny, France

[21] Appl. No.: 64,934

[22] Filed: May 24, 1993

[30] Foreign Application Priority Data

May 25, 1992 [FR] France ..... 92 06355

[51] Int. Cl.[6] ..... B62B 3/00

[52] U.S. Cl. ..... 280/63; 280/79.11

[58] Field of Search ..... 280/79.11, 63, 280/79.7, 37, 47.131, 62; 16/47, 29, 18 CG, 18 B; 190/18 A

[56] References Cited

U.S. PATENT DOCUMENTS

| | | | |
|---|---|---|---|
| 746,816 | 12/1903 | Goddard | 280/63 |
| 765,751 | 7/1904 | Ott | 280/63 |
| 2,596,578 | 5/1952 | McIntyre et al. | 190/18 A |
| 2,675,245 | 4/1954 | Tobias | 280/47.131 |
| 2,964,329 | 12/1960 | Beck | 280/47.131 |
| 3,057,002 | 10/1962 | Levin et al. | 16/24 |
| 3,532,355 | 10/1970 | Hawkes | 280/47.131 |
| 3,580,601 | 5/1971 | Miles | 280/47.131 |
| 4,168,558 | 9/1979 | Walker et al. | 16/18 CG |
| 4,589,530 | 5/1986 | Sher | 16/29 |
| 5,134,753 | 8/1992 | Rekuc | 16/18 CG |

FOREIGN PATENT DOCUMENTS

| | | | |
|---|---|---|---|
| 1197511 | 12/1959 | France | 16/18 CG |
| 212352 | 3/1924 | United Kingdom | 190/18 A |
| 9112744 | 9/1991 | WIPO | 280/37 |

*Primary Examiner*—Richard M. Camby

*Attorney, Agent, or Firm*—Finnegan, Henderson, Farabow, Garrett & Dunner

[57] ABSTRACT

Wheeled support mechanism and luggage incorporating at least such a mechanism.

Trunks, luggage and suitcases comprising at least a wheeled support mechanism.

The mechanism comprises a body 1 of elongated shape in the form of a sliding runner, a forward wheel 3 rotatable and a fixed posterior steering wheel 5 (at the back).

6 Claims, 3 Drawing Sheets

FIG.1
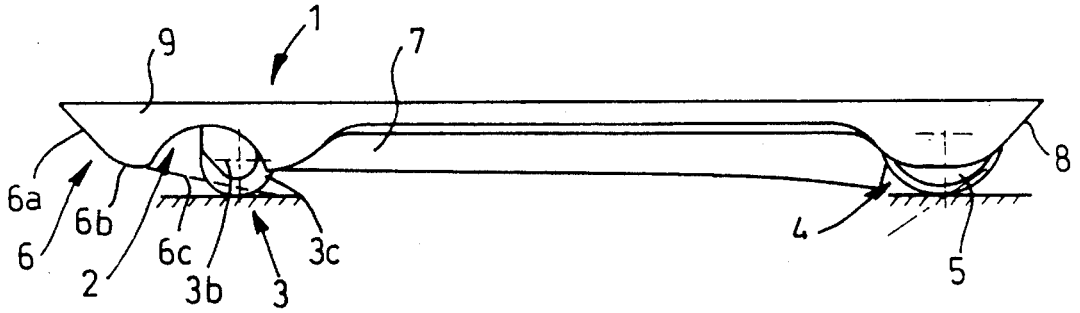
FIG 2
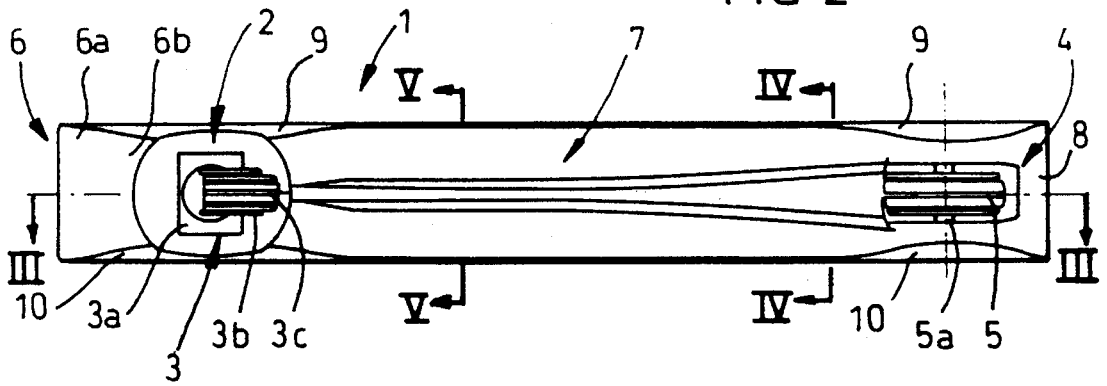
FIG.3
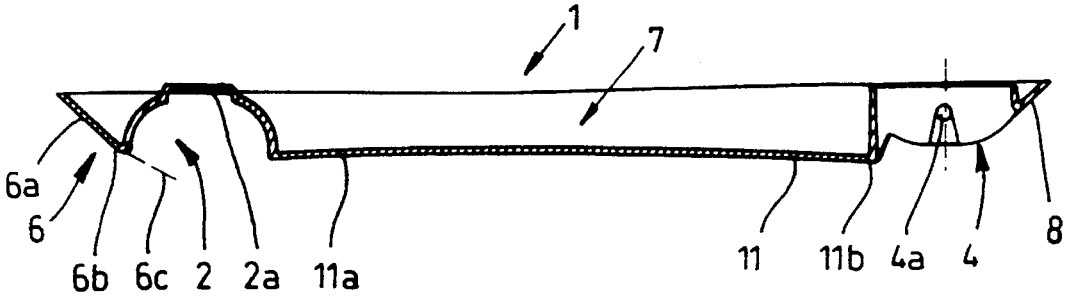
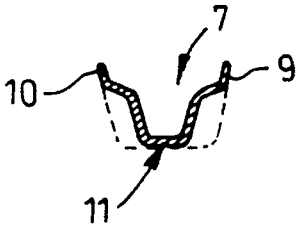
FIG.4
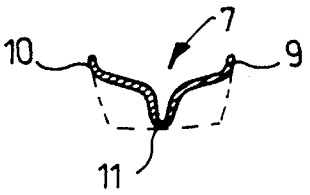
FIG.5

SUPPORTING DEVICE WITH ROLLERS, AND SUITCASES COMPRISING AT LEAST ONE SUCH DEVICE

The invention refers to a supporting device with rollers, and suitcases comprising at least one such device.

Such supporting devices are used to transport relatively heavy individual loads such as luggage, trunks, suitcases and the like.

We are familiar with suitcases equipped with incorporated rollers to facilitate transport and with a sleeve or handle or carrying strap to facilitate pulling and gripping it.

Known suitcases have the disadvantage that in the presence of obstacles, the casters block or are pulled off by the user's pulling; this is the case particularly when the obstacles in question are numerous steps of a staircase.

The purpose of the invention is to remedy the aforementioned disadvantages by creating a new support that is adaptable in permanent or removable manner to a suitcase, and is able to cross over obstacles without damage by sliding on those obstacles.

The object of the invention is a supporting device with rollers and adaptable to a piece of luggage, a suitcase, a trunk or the like, characterised in that it has an elongated body formed as a sliding block, that at its front the body has a housing for an adjustable caster, and that at its rear the body has a housing to accommodate a fixed direction caster, and these two housings are embedded.

According to other characteristics of the invention:

- the body has a front part that is sloped in relation to the rolling plane;
- the front part has a surface whose tangent plane at the end meets the wheel of the adjustable caster considerably below the lower third when this wheel is pointed in the direction of regular use;
- the body has a central part with a lower edge sloped downward from front to rear;
- the central part has a section that widens from front to back;
- the adjustable and fixed rollers are embedded in housings that are protected by the front and rear sloped planes and the central part that separates them, in such a way that the device has a shape allowing it to advance by combination of sliding and/or rolling in spite of obstacles;
- the device is designed in the general shape of a flared U, the flaring of which is opposite to the moving plane;
- the body has a V-shaped section designed inside the general contour in flared U shape.

Another object of the invention is a suitcase comprising at least one device according to the invention.

In the case of a flexible suitcase, it will be advantageous if:

- the bottom is stiffened by a rigid plate of any appropriate material, to which at least one device is attached;
- the plate is attached to the device/s, for example by screwing, latching or a similar process.

The invention will be better understood with the help of the description that follows, provided as a non-restrictive example compared with the attached drawings in which:

FIG. 1 shows a side view of a device according to the invention;

FIG. 2 shows a top view of a device according to the invention;

FIG. 3 shows a partial section view along line III—III of FIG. 2;

FIG. 4 shows a partial section view along line IV—IV of FIG. 2;

FIG. 5 shows a partial section view along line V—V of FIG. 2;

Figure 6:
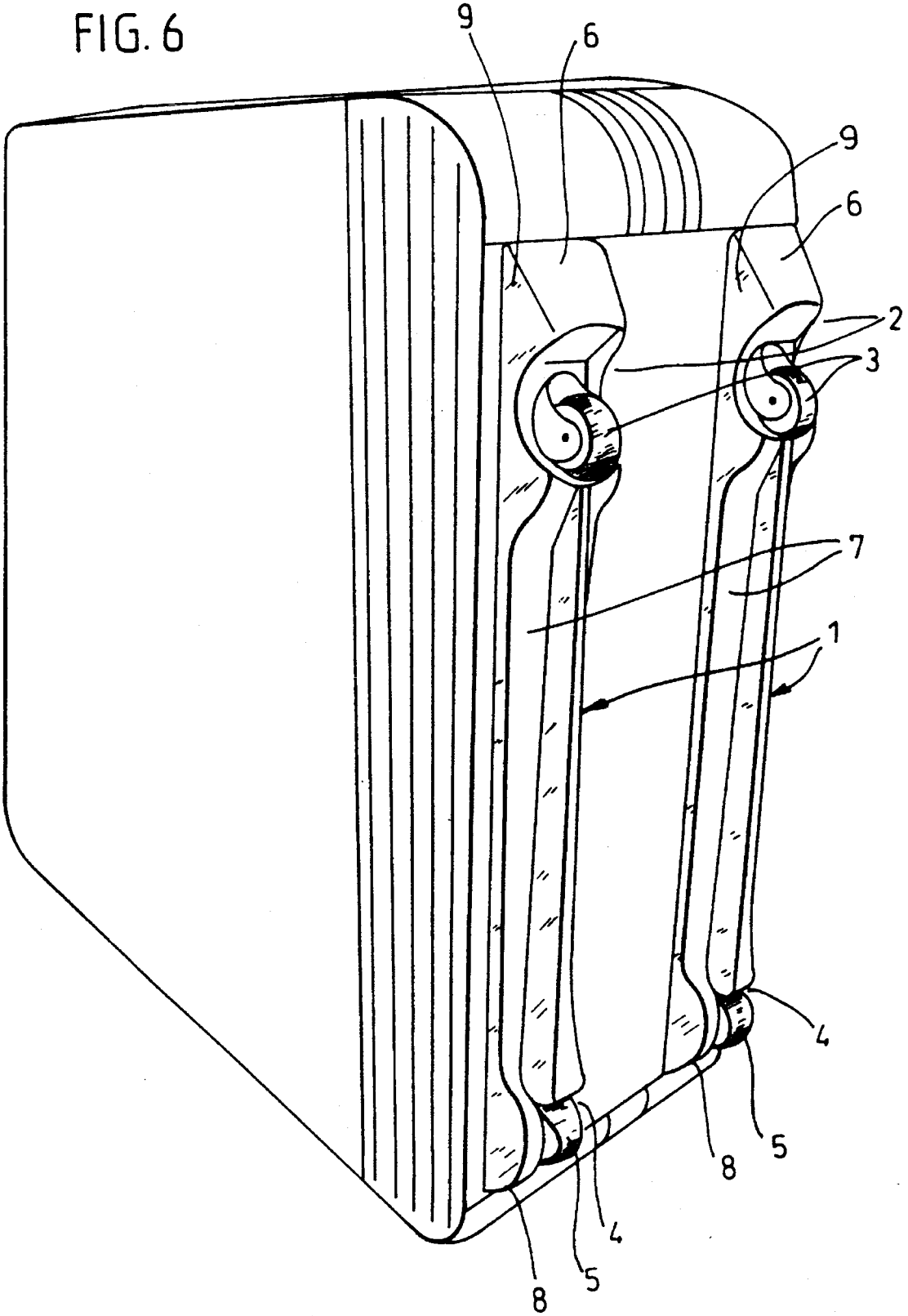
FIG. 6 shows a perspective view of a suitcase assembled with two supports according to the invention.

In relation to FIG. 1, a device according to the invention has an elongated body formed as a sliding block in the longitudinal direction.

The body 1 has, at its front part (in relation to the direction of use) a housing 2 forming a directing tray for an adjustable caster 3. The body 1 has at its rear part a housing 4 to accommodate a fixed direction caster 5 directed in such a way that rolling takes place in the longitudinal direction of the body 1.

The adjustable caster 3 is mounted on the body 1 with the help of a base plate **3*a* with, for example, a rectangular shape, on which an axis support assembly 3*b* is mounted with the ability to pivot. In this example, the axis support assembly 3*b* has a circular plate and two lateral arms joined and largely perpendicular to this base plate; the two lateral arms support the wheel 3*c***.

The caster 5 oriented longitudinally in relation to the body 1 is mounted rotating directly on the body 1 by means of its axis **5*a***.

According to the invention, the body 1 is formed as a sliding block and has a front part 6 sloped in relation to the rolling plane.

The front part 6 has a first surface **6*a*** largely plane and sloped, at an angle of 30 degree to 60 degree, for example in relation to the rolling plane.

The surface **6*a* connects tangentially to a surface 6*b*** in a generally convex shape.

The tangent plane **6*c* at the end of the surface 6*b* (symbolised by dotted lines on FIGS. 1 and 3) meets wheel 5*c* largely below the lower third of wheel 3, when this wheel is directed in the direction of regular use, i.e., the surface of intersection of the plane 6*c* with the wheel 3*c*** is seen from the rotation axis at an angle or near to or less than 120 degree.

The central part 7 of the body 1 has a general V-shape without sharp angles liable to catch on an edge or any obstacle.

The rear part 8 of the body 1 has a largely plane surface sloped in relation to the rolling plane at an angle of 30 degree to 60 degree, for example; the extension of this surface (in dotted lines) meets the fixed direction caster 5.

We thus obtain an embedding of part of the adjustable caster in a housing 2 so as to be protected from jolts by the surfaces **6*a*, 6*b* and 11*a*, and an embedding of the fixed caster 5 in a housing 4 so as to be protected by surfaces 11*b* and 8**. This embedding allows obstacles such as steps to be crossed over easily.

In relation to FIG. 2, on which identical reference figure designate identical elements to those of FIG. 1, the device according to the invention is designed in a generally U-shaped contour the sides 9, 10 of which are flared opposite to the rolling plane.

In relation to FIG. 3, the front housing 2 has a reinforcement **2*a* or a similar cooperating shape to attach the base plate 3*a* of the front caster 3**.

The rear housing 4 has at least one opening or the like **4*a* for the housing of a rotation axis 5*a* for a caster 5. The axis 5*a* is preferably at right angles and runs through two openings 4*a* arranged on each side of the housing 4**.

The central part 7 has a lower edge 11 sloped downward from front to rear in such a way that the front 11*a* of the lower edge 11 is located largely below the level of the axis of the wheel 3*c* and that the rear 11*b* of the lower edge 11 is located slightly above the rolling plane of the caster 5.

In relation to FIGS. 4 and 5, the central part 7 is designed in the general contour shown in dotted lines in the U shape of the device.

The central part 7 has a section that widens from front to rear and that has a V-shaped section the point of which is formed by the lower edge 11.

According to the invention, the supporting device with rollers has a shape that is always touching the ground and that allows advancing by combination of sliding and/or rolling in spite of the obstacles of various shapes encountered.

The general U shape prevents embedding in a narrowing, the widening of the V-shaped section ensures the stability of the load supported; the pivoting of the front caster allows direction to be changed effortlessly.

In relation to FIG. 6, a suitcase according to the invention is equipped with two devices according to the invention; they are largely parallel with each other and with the sides of the suitcase.

The front casters 3 of the device according to the invention are located on the same side in the normal rolling direction.

Of course, the invention also applies to any form of container: trunk, box, etc. equipped with any number of devices according to the invention and attached permanently (by heat welding, cementing, riveting or a similar process) or in removable manner (screwing, latching or a similar process).

The invention applies to all types of suitcases, whether they are rigid or not.

In particular, in the case of completely flexible suitcase (of leather, cloth or the like), one need only a stiffen the bottom of the suitcase with a plate made of any appropriate rigid material and to which the block or blocks will be attached.

Figure 7:
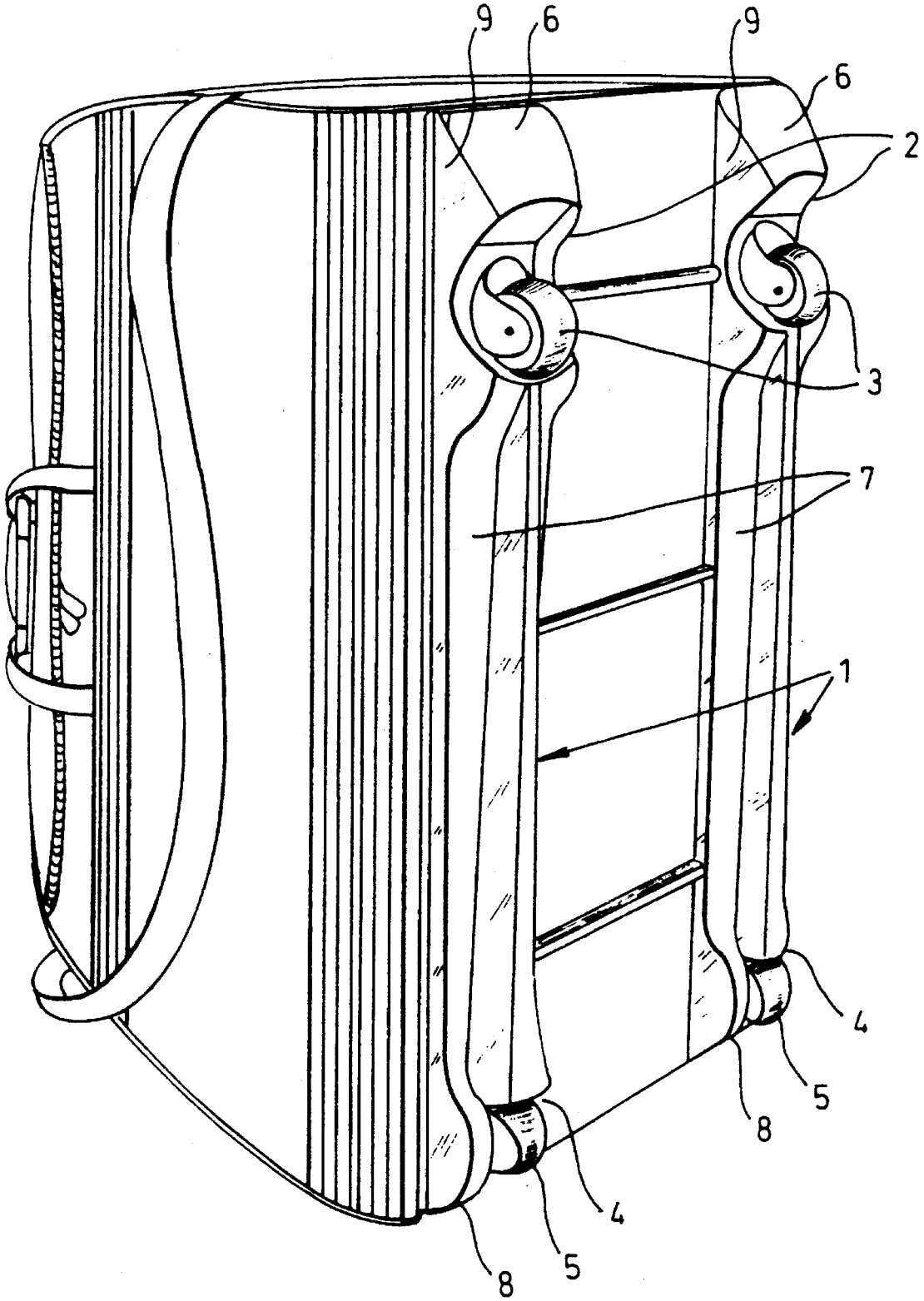
FIG. 7 shows a perspective view of a suitcase assembled with a plate support according to the invention.

According to the invention, the device can be produced as shown in FIG. 7, i.e., composed of two blocks joined to a rigid plate so as to form a sort of roller board that can be attached to the bottom of any flexible suitcase so as to stiffen its bottom on the one hand and, on the other hand, to equip it with wheels.

According to the invention, it is advantageous if the device can be automatically mounted directly at the end of the suitcase assembly line; it will then be composed, at least on the side intended to be assembled to the suitcases, of the same material or a material compatible with that of the suitcases (in particular, a thermoplastic material such as polypropylene).

Advantageously, the device can also made in one piece (by molding, thermoforming or a similar process) with the suitcase or with the rigid plate in the case of a flexible suitcase.

I claim:

1. A flexible suitcase or trunk comprising a bottom stiffened by a rigid plate and at least one supporting and rolling device attached to the rigid plate, the supporting and rolling device including an elongated body formed as a sliding block and having a front part that is sloped in relation to a rolling plane, a first housing embedded within the front part and a second housing embedded with a rear part of the elongated body, the first housing receiving an adjustable caster and the second housing receiving a fixed direction caster.

2. The suitcase according to claim 1, wherein the plate is attached to the device by screwing, latching, or a similar process.

3. The suitcase according to claim 1, wherein the plate is made in one piece with the device.

4. A supporting and rolling device for supporting a piece of luggage, a suitcase, or a trunk, comprising an elongated body formed as a sliding block and having a front part, a rear part, and a central part with a lower edge sloped downward from front to rear, a first housing embedded within the front part and a second housing embedded within the rear part;

the first housing receiving an adjustable caster and the second housing receiving a fixed direction caster.

5. A supporting and rolling device for supporting a piece of luggage, or a trunk, comprising an elongated body formed as a sliding block, a first housing embedded within a front part of the elongated body and a second housing embedded within a rear part of the elongated body, the first housing receiving an adjustable caster and the second housing receiving a fixed direction caster;

wherein the elongated body is generally in the shape of a flared U, the flaring of which is opposite to a moving plane, the body further including a V-shaped section inside the general contour of the flared U-shape.

6. A supporting and rolling device for supporting a piece of luggage, a suitcase, or a trunk, comprising an elongated body formed as a sliding block and having a front part, a rear part, and a central part with a lower edge sloped downward from front to rear and a section that widens from front to back, a first housing embedded within the front part and a second housing embedded within the rear part;

the first housing receiving an adjustable caster and the second housing receiving a fixed direction caster.

* * * * *